US007441984B2

(12) United States Patent
Kramer

(10) Patent No.: US 7,441,984 B2
(45) Date of Patent: Oct. 28, 2008

(54) CONCRETE SLAB DOWEL SYSTEM AND METHOD FOR MAKING AND USING SAME

(76) Inventor: Donald R. Kramer, 3673 Old Lewis River Rd., Woodland, WA (US) 98674

( * ) Notice: Subject to any disclaimer, the term of this patent is extended or adjusted under 35 U.S.C. 154(b) by 507 days.

(21) Appl. No.: 11/187,767

(22) Filed: Jul. 22, 2005

(65) Prior Publication Data

US 2006/0177268 A1 Aug. 10, 2006

Related U.S. Application Data

(63) Continuation-in-part of application No. 11/056,313, filed on Feb. 10, 2005, now Pat. No. 7,201,535.

(51) Int. Cl.
*E01C 11/18* (2006.01)

(52) U.S. Cl. ..... 404/52; 404/62; 404/63; 52/396.02

(58) Field of Classification Search ..... 404/47, 404/52, 56, 59, 60, 61, 62, 63, 135; 52/396.02
See application file for complete search history.

(56) References Cited

U.S. PATENT DOCUMENTS 3,397,626 A 8/1968 Kornick
4,449,844 A 5/1984 Larsen
4,578,916 A 4/1986 Witschi
4,733,513 A 3/1988 Schrader
5,005,331 A 4/1991 Shaw
5,216,862 A 6/1993 Shaw
5,713,174 A 2/1998 Kramer
5,797,231 A 8/1998 Kramer
7,201,535 B2 * 4/2007 Kramer ..... 404/52

* cited by examiner

*Primary Examiner*—Gary S Hartmann
(74) *Attorney, Agent, or Firm*—Marger Johnson & McCollom PC

(57) ABSTRACT

A plurality of sleeve members for receiving and maintaining a dowel bar therewithin can be provided so that the dowel bar does not transmit substantial shear stresses to the concrete during the contraction and expansion of the concrete. The sleeve members can comprise (a) at least one hollow interior compartment for receiving and supporting said dowel bar, and (b) at least one aperture for receiving a bracket member. The dowel bar can have a tapered configuration and a pair of end sections. The dowel bar can be located within the hollow interior compartment for maintaining adjacent sections of concrete in alignment during contraction and expansion of the concrete, and for transferring shear stresses and bending moments across a joint formed between adjacent concrete slabs. The dowel bar can move in a lateral and/or longitudinal path within the hollow interior compartment and exerting interactive forces in response to the expansion and contraction of the concrete. A plurality of bracket members located on an underlying surface can support the sleeve members and the dowel bar above the underlying surface.

27 Claims, 5 Drawing Sheets

CONCRETE SLAB DOWEL SYSTEM AND METHOD FOR MAKING AND USING SAME

RELATED APPLICATION

This application is a continuation-in-part of U.S. patent application Ser. No. 11/056,313 filed on Feb. 10, 2005 now U.S. Pat. No. 7,201,535.

BACKGROUND OF THE INVENTION

This invention relates to dowel systems which can be employed as tying members between concrete bodies, and more particularly, to dowel systems which facilitate load transfer and dowel slippage across slab joints so as for maintaining the structural integrity of concrete slabs.

Concrete responds to changes in temperature and moisture when movement associated with these changes (or for other reasons such as internal chemical reaction) is restrained. In these instances stresses develop that can lead to cracking. To control cracking, joints are built at interval distances short enough to maintain stresses in the concrete below certain critical values. Transverse joints are saw cut, placed through induced cracking, or formed at predetermined spacings.

Concrete pavements for highways, airport runways and the like are generally placed in strips or lanes with a longitudinal joint formed between adjacent strips or lanes. Concrete is poured in the first strip and allowed to cure. Subsequently, concrete is poured and cured in the adjacent strip and so on until the concrete pavement is completed. A longitudinal joint is formed between adjacent strips to facilitate construction and to reduce stresses and control cracking caused by contraction or expansion of the concrete. Transverse or slug joints are also formed in concrete by cutting or sawing the concrete at a given location and to a given depth.

Similarly, joints are formed in concrete structural slabs, walls, footings and the like to minimize stresses and/or simplify construction methods. Of these joints, there are several types. For example, the expansion joint provides a space between slabs to allow for expansion or swelling of the slab as temperature and moisture increase or growth due to any cause occurs. A construction joint provides a finished edge or end so that construction operations interrupted for some length of time may be continued or resumed without serious structural penalty.

Load is transferred across a joint principally by shear. Some bending moment may be transferred across the joints through tie joints. Good load transfer capability must be built into the joint, or the load carrying ability of the concrete slab or structure will be reduced. The alternative is to strengthen the concrete by improving support or increasing depth to minimize the joint load transfer weakness.

Tie bars and dowels are often used in concrete design to improve load transfer at the joint between concrete bodies such as slabs or structures. Such tie bars and dowels are embedded in the concrete and arranged across the joint in a direction substantially perpendicular to the axis defined by the joint. Various approaches, depending on the type of tie bar or dowel, have been suggested with respect to concrete construction joints.

In the construction of concrete slabs on grade, it is common practice to install continuous side forms with dowels for future adjacent slab concrete placement and to place concrete in long continuous strips. It is also known to place slab dowels and sleeves at specified distances across the strips to allow the strips to have a controlled plane to accommodate shrinkage of the concrete. The positions of these dowel locations are marked on the side forms and the concrete after placement and finishing is struck to provide a joint at these locations, or is later sawn. This allows for a smooth controlled joint across the slab strip. However, many times the marks are destroyed and joints are placed in the wrong areas negating the advantages of the slab dowels.

The functions of the tie bars and dowels are to keep contiguous sections of concrete in alignment during contraction and expansion, and to transfer shear stresses and bending moments across the joint between adjacent slabs. The prior art dowels are often made smooth, lubricated, or coated entirely with plastic as disclosed in U.S. Pat. No. 3,397,626 to prevent the dowel from bonding to the concrete and allow the concrete slab or structure to slide relative to the dowel in a direction substantially perpendicular to the axis defined by the joint. Such movement of the slab relative to the dowel prevents build up of stress in the dowel that may result in cracking of the concrete.

In an alternative construction disclosed in U.S. Pat. No. 4,449,844, the dowel has its outer ends bonded to concrete and its central portion covered with plastic to prevent bonding to concrete. The dowel disclosed performs a latent spring function to limit the movement of the concrete slab relative to the dowel when temperature changes cause the length of the slab section to vary with time.

A major disadvantage of the above prior art dowels and tie bars is that they prevent movement of the concrete slab relative to an adjacent concrete slab in a direction substantially parallel to and aligned with the axis defined by the joint. In such situations, the dowels and tie bars provide enough restraint against movement and shrinkage so that the concrete slab or structure induces stresses along a line substantially defined by ends of the dowels or tie bars. This problem is most evident in the situation where adjacent concrete slabs or strips are placed and cured in repetitive order, or when adjacent concrete slabs or structures are subjected to extreme temperature differences.

For example, it is well known that concrete typically shrinks after formation. If a second concrete paving slab is placed adjacent to a first concrete paving slab that has contracted from thermal and drying shrinkage, the second concrete paving slab will likewise attempt to shrink in a manner similar to the shrinkage of the first concrete paving slab. However, dowels and tie bars arranged across the joint between the first and second concrete paving slabs will restrain the second concrete paving slab from shrinking during curing. The developed internal stress in the second concrete paving slab can create an undesirable condition that may result in cracking. Even if cracks do not develop, the internal stresses are added to the stress from the normally applied design loads and could reduce the service life of the pavement.

Another prior art slab dowel system, U.S. Pat. No. 4,578,916, relates to a connecting and pressure-distributing element for two structural members to be concreted one after the other in the same plane and separated by a joint, of the type having a socket and a bar insertable into the opening of the socket. The socket is inserted for attachment to a frontal concrete form and for embedding in the structural member to be concreted first. The bar is inserted into the socket hole and is intended for embedding in the structural member to be concreted later. The bar has at least two closed loops each of generally rectangular shape and made from reinforcing rods. The loops are secured to the socket and the bar, respectively, in one case by welding, in another case by means of a holder, because they are symmetrically spaced from the socket and the bar, they ensure good distribution of pressure within the concrete.

An improved tying bar and joint construction for transferring stresses across a joint between concrete slabs or structures and accommodating for shrinkage and expansion of concrete is provided in U.S. Pat. No. 4,733,513. The subject bar has a resilient facing attached to at least one side of the bar so that the concrete slab or structure can move in relationship to the bar in a direction substantially perpendicular to the resilient facing. The bar is arranged across the joint in a direction substantially perpendicular to the axis defined by the joint.

In U.S. Pat. No. 5,005,331, slip and non-slip dowel placement sleeves are disclosed. The slip dowel placement sleeve generally comprises a tubular dowel receiving sheath having a closed distal end and an open proximal end. A connecting means of perpendicular flange is formed around the proximal opening of the sheath to facilitate attachment of the sheath to a concrete form. Smooth sections of dowel rod may then be advanced through holes drilled in the concrete form and into the interior compartment of the sheath. Concrete is poured within the form and the dowel rod remains slidably disposed within the interior of the sheath. Variations of the basic slip dowel placement sleeve of the invention includes a tapered "extractable" sleeve and a corrugated "grout tube" for placement of non-slip dowel or rebar.

Slip and non-slip dowel placement sleeves are disclosed in U.S. Pat. No. 5,216,862. The slip dowel placement sleeve generally comprises a tubular dowel receiving sheath having a closed distal end and open proximal end. A connecting means is formed around or inserted into the proximal opening of the sheath to facilitate attachment of the sheath to a concrete form. Smooth sections of dowel rod may then be advanced through holes drilled in the concrete form and into the interior compartment of the sheath. Concrete is poured within the form and the dowel rod remains slidably disposed with the interior of the sheath. Variations of the basic slip dowel placement sleeve of the invention include a tapered extractable sleeve and a corrugated grout tube for placement of non-slip dowel or rebar.

In U.S. Pat. Nos. 5,713,174 and 5,797,231, a concrete dowel slab joint system, including a collapsible spacer member, is provided.

All of the U.S. patents cited above are incorporated herein in their entirety by reference.

SUMMARY OF THE INVENTION

It has now been determined that cracking problems in concrete slabs, caused by substantial shear stresses imparted to the concrete by movement during expansion and contraction of the concrete slab of dowel bars located therewithin, can be avoided. More specifically, the cracking problem can be overcome by employing a concrete dowel system of the present invention which permits the dowel bar to undergo movement in both a lateral and longitudinal direction without imparting substantial shear stress to the concrete itself.

The subject concrete dowel slab joint system can comprise a plurality of sleeve members for receiving and maintaining a dowel bar therewithin so that the dowel bar does not transmit substantial shear stresses to the concrete during the contraction and expansion of the concrete. The sleeve members can comprise (a) at least one hollow interior compartment for receiving and supporting the dowel bar, and (b) at least one aperture for receiving a bracket member. The sleeve member can define an opening in communication with the hollow interior compartment for venting air into the atmosphere surrounding the sleeve assembly when the dowel bar is introduced into the hollow interior compartment.

The dowel bar can have a tapered configuration and a pair of end sections. The dowel bar can be located within the hollow interior compartment for maintaining adjacent sections of concrete in alignment during contraction and expansion of the concrete. It can also transfer shear stresses and bending moments across a joint formed between adjacent concrete slabs, the dowel bar moving in a lateral and/or longitudinal path within the hollow interior compartment and exerting interactive forces in response to the expansion and contraction of the concrete. The tapered configuration of the dowel bar can provide supplemental structural support for the dowel bar which is sufficient to overcome the effect caused if concrete joint separation skews the original position of the dowel bar.

The dowel bar can preferably comprise an upper outer surface, a lower outer surface and a pair of side outer surfaces, and at least one of the pair of side outer surfaces comprises a tapered configuration which gradually narrows toward each the end section of the dowel bar. Preferably, the pair of side outer surfaces can comprise a tapered configuration which gradually narrow toward each the end section of the dowel bar. The slope of the tapered configuration can preferably extend from substantially the middle portion of the dowel bar and gradually narrows toward each of the end sections.

A plurality of bracket members can also be provided. The bracket members can be located on an underlying surface for supporting the sleeve members and the dowel bar above the underlying surface. Each of the bracket members can comprise at least one connection element which is engagingly insertable into each aperture. Each bracket member and sleeve member can be movable with respect to each other when shrinkage of the concrete occurs.

The bracket member can include a stanchion joined to the connection element and located on the underlying surface for supporting the sleeve member and the dowel bar, respectively. The bracket member preferably comprises a support framework. The bracket member can support the dowel bar at a plurality of heights with respect to the underlying surface. The bracket member can comprise a plurality of connection elements. The support members can defines a plurality of apertures for receiving a bracket member at a plurality of locations for adjusting the height of the dowel bar to a plurality of locations with respect to the underlying surface. The connection element, and the aperture into which the connection element is engagingly inserted, can have a cross-sectional configuration which is not circular in shape so that the connection element will substantially prevented from rotating within the aperture.

The sleeve member can be fabricated of a polymeric material. The bracket member can be fabricated of a polymeric material or a metal material. The dowel bar can be fabricated of a metal material or a polymeric material.

A method for maintaining adjacent sections of concrete in alignment during contraction and expansion of the concrete and for transferring shear stresses and bending moments across a joint formed between adjacent concrete slabs can also be provided. The method can comprise providing the above-described sleeve members for receiving and maintaining the dowel bar therewithin. Then, the subject dowel bar can be provided.

Next, the dowel bar can be located within the hollow interior compartment for maintaining adjacent sections of concrete in alignment during contraction and expansion of the concrete. Again, this can allow transferring shear stresses and bending moments across a joint formed between adjacent concrete slabs. In this case, the dowel bar can move in a lateral and/or longitudinal path within the hollow interior compartment and exerting interactive forces in response to the expansion and contraction of the concrete so as not to transmit substantial shear stresses to the concrete during the contraction and expansion of the concrete. The dowel bar can also be capable of movement to a position which is substantially non-parallel with respect to an original position of the dowel bar when the concrete dowel slab joint system was originally installed.

A plurality of bracket members can then be provided. Each of the bracket members can be located on an underlying surface. Each bracket member can also comprise at least one connection element.

Then, each of the connection element is engagingly inserted into each of the apertures for supporting the sleeve assembly and dowel bar above the underlying surface. Each bracket member and sleeve assembly can be movable with respect to each other when shrinkage of the concrete occurs.

The foregoing and other objects, features and advantages of the invention will become more readily apparent from the following detailed description of a preferred embodiment which proceeds with reference to the drawings.

DETAILED DESCRIPTION OF PREFERRED EMBODIMENT

Conventional slab dowels are positioned within concrete sections. In a typical concrete formation sequence, the first concrete slabs and second concrete slabs are poured in sequence. Transverse joints are then saw cut or formed through methods well known in the prior art to reduce and/or relieve stresses in the concrete and prevent cracking. A longitudinal joint is formed between the two concrete strips comprising the first concrete slab and the second concrete slab.

Dowel bars are embedded in the concrete slabs for maintaining adjacent sections of concrete in alignment during contraction and expansion of the concrete, and for transferring shear stresses and bending moments across a joint formed between adjacent concrete slabs. The cross-sectional sizes and lengths of the dowel bars vary depending on the types of installation and the required forces to be counteracted. The dowel bars are placed and supported with respect to transverse joints and longitudinal joint.

Figure 1:
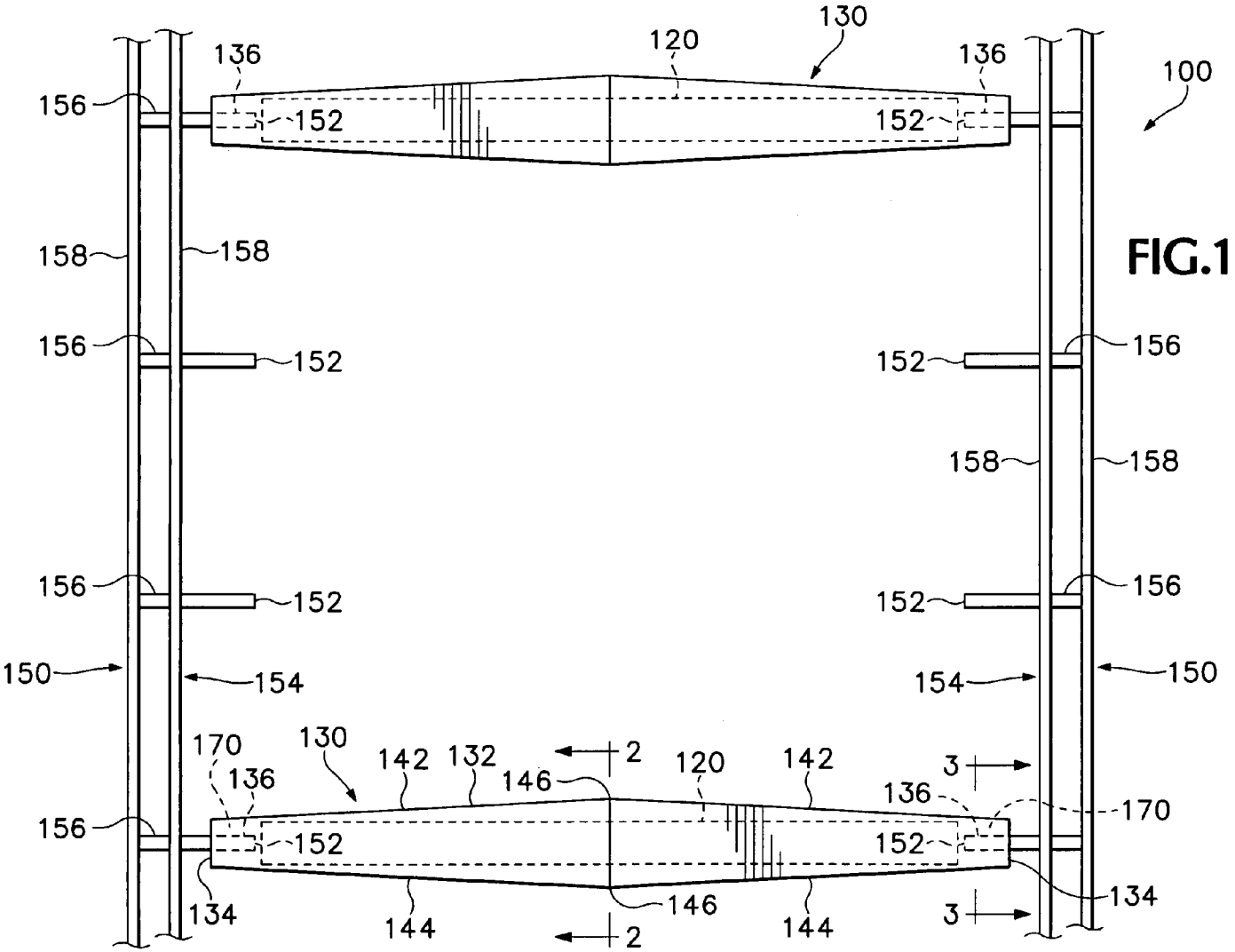
FIG. 1 is a plan, perspective view of a portion of a first concrete slab joint system of the present invention comprising a pair of sleeve assemblies, each including a dowel bar, and a pair of bracket members supporting the sleeve assemblies and dowel bar.
Figure 3:
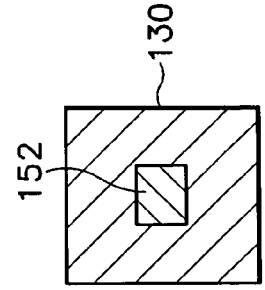
FIG. 3 is a sectional view of the sleeve assembly and dowel bar taken along line 3-3 of FIG. 1.

As described in FIG. 1 and in column 6, line 40 through column 7, line 44 of U.S. Pat. No. 5,797,231, which is commonly owned by the inventor of this patent application, sleeve dowel bar assemblies are embedded in the first concrete slabs, and arranged across the transverse transfer joint, 22*a* to 22*e* and, 23*a* to 23*e*, in a direction substantially perpendicular to the axes defined by the transverse transfer joint. Similarly, dowel sleeves are embedded in the first concrete slabs and arranged across the joint in a direction substantially perpendicular to the axes defined by the longitudinal transfer joint 24*a* to 28*a*, etc. In a typical installation sleeve, dowel bars assembly 32 is positioned on the rebar-matrix, and the concrete slab is poured. The concrete slab is allowed to harden in situ with the sleeve dowel bars assembly and dowel sleeves embedded therein.

After the first concrete slab has undergone expansion or contraction from thermal or drying shrinkage, the second concrete slab is placed adjacent to the first concrete slab after the dowel bars are inserted into the sleeves previously placed in the prior concrete pour so that the dowel bars are also essentially embedded in the second concrete slabs. The second concrete slab will attempt to shrink during curing in a similar manner to the shrinkage of the first concrete slab.

In a conventional installation, the dowel bars arranged across longitudinal joints between the first and second concrete slabs will attempt to restrain the second concrete slabs from movement. The developed and internal stress in the second concrete slab can create an added stress which may cause cracking by itself or when added to an applied load upon the slabs. The cracks will often develop along a line near the ends of the dowels bars.

When the prior art dowel bars are replaced by the concrete dowel slab joint systems 100 and 210 of the present invention, they are held in firm position and resist displacement of one concrete slab relative to the other as in the case of conventional dowel bars. The concrete dowel slab joint systems 100, unlike its prior art counterparts, maintains adjacent sections of concrete in alignment during contraction and expansion of the concrete, and transfers shear stresses and bending moments across a joint formed between adjacent concrete slabs despite the magnitude of the resultant joint. A major reason for this the presence of the tapered configuration of the sleeve assembly or the dowel bar, respectively, which provides supplemental structure for handling the transfer of the aforementioned shear stresses and bending moments across the concrete joint.

Figure 2:
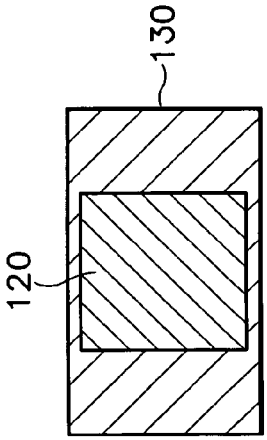
FIG. 2 is a sectional view of the sleeve assembly and dowel bar taken along line 2-2 of FIG. 1.

Referring now to FIGS. 1 and 2, concrete dowel slab joint system 100 of this invention are depicted. More specifically, the system 100 receives dowel bar 120, which is typically an elongate dowel bar fabricated of a metallic or polymeric material, preferably a conventional steel dowel bar. Dowel bar 120, which can have a square, rectangular, round or oval cross-sectional area, is maintained in position within a sleeve assembly 130 and is supported by a pair of bracket members 150 above underlying surface 200. More specifically, sleeve assembly 130 receives and maintains dowel bar 120 within its confines (see FIG. 2) without transmitting substantial shear stresses to the concrete slab 300 during the contraction and expansion of the slab 300. Dowel bar 120 moves in a lateral and/or longitudinal path within the hollow interior compartment and exerts interactive forces in response to the expansion and contraction of the concrete. Dowel bar 120 is also preferably capable of movement to a position which is substantially non-parallel with respect to its original position when the concrete dowel slab joint system 100 was originally installed in the concrete slab 300.

More specifically, sleeve assembly 130 comprises an elongate sleeve body 132 defining a hollow interior compartment 170. Sleeve body 132 includes a pair of end sections 134, each the end section defining a hollow aperture 136. The elongate sleeve body includes an upper outer surface 138, a lower outer surface 140 and a pair of side outer surfaces 142, 144. Side outer surfaces 142, 144 comprise a tapered configuration the slope of which extends from substantially the middle portion 146 of the elongate sleeve body and gradually narrows toward each of the end sections 134. The tapered configuration of the elongate sleeve body 132 provides supplemental structural support for the dowel bar 120 which is sufficient to overcome the effect caused if concrete joint separation skews the original position of the dowel bar 120. The angle of the slope of the side outer surfaces 142, 144 from the end sections 134 to the middle portion 146.

A pair of bracket members 150 is located on underlying surface 200 for supporting the sleeve assembly 130 and the dowel bar 120 located therewithin above underlying surface 200. Bracket member 150 comprise a plurality of connection elements 152 which is engagingly insertable into each the aperture. Bracket member 150 and sleeve assembly 130 are movable with respect to each other when shrinkage of the concrete occurs.

Bracket member 150 can include stanchion 154 joined to the connection element 152 which is located on the underlying surface 200 for supporting the sleeve assembly 130 and the dowel bar 120. The stanchion 154 can comprise a support framework including generally vertically-extending support members 156 joined to generally horizontally-extending support members 158. Members 156 can be joined to members 158 by welding same one to the other. Typically, connection elements 152 and vertically-extending support members 156 are formed of a unitary, single-piece construction. For purposes of providing stability to the system 100, the upper portion of the vertically-extending support members 156 extends in an inwardly angular plane toward the sleeve assembly 130. For purposes of providing further stability, a hold-down pin 160 can be joined to the lower end of the vertically-extending support members 156. Each bracket member 150 supports a plurality of sleeve assemblies 130 and dowel bars 120, respectively.

Figure 4:
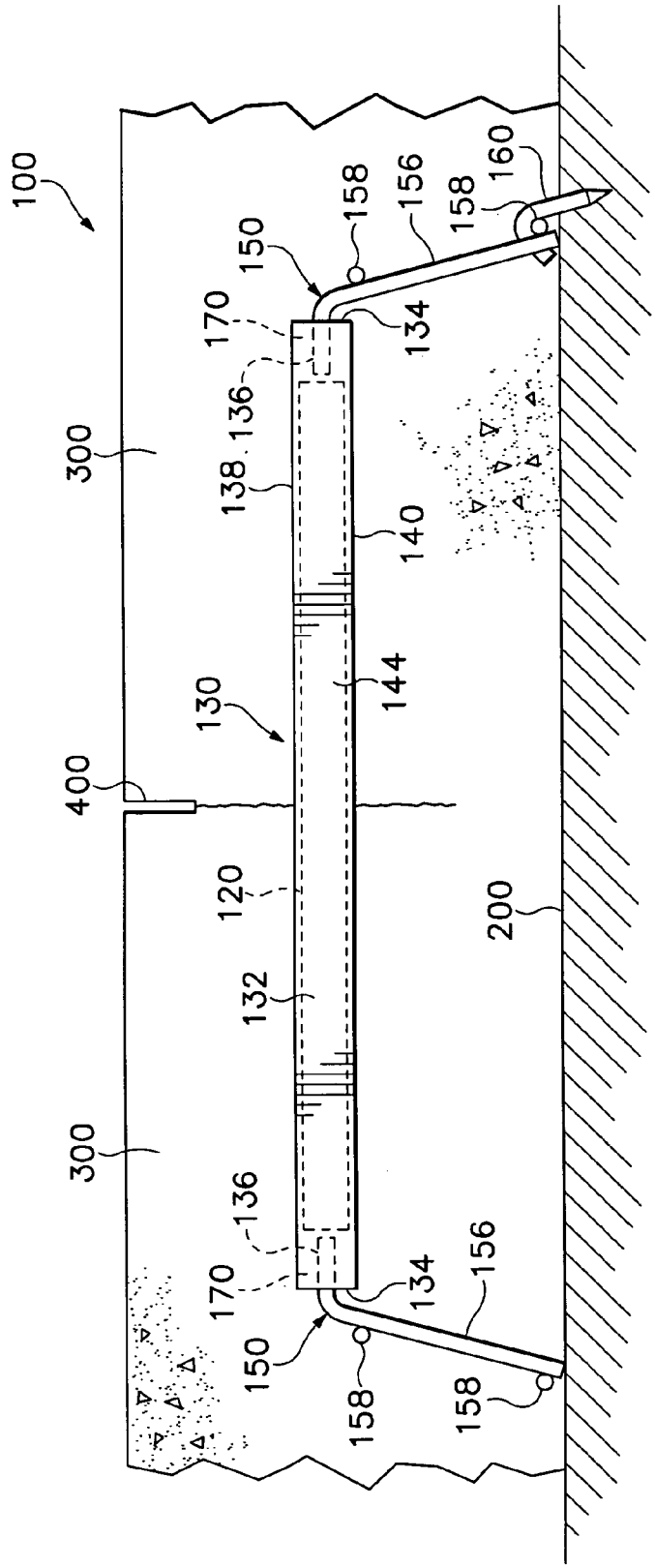
FIG. 4 is side, perspective view of the concrete slab joint system of FIG. 1, embedded within concrete slab 300 and supported on underlying surface 200.
Figure 5:
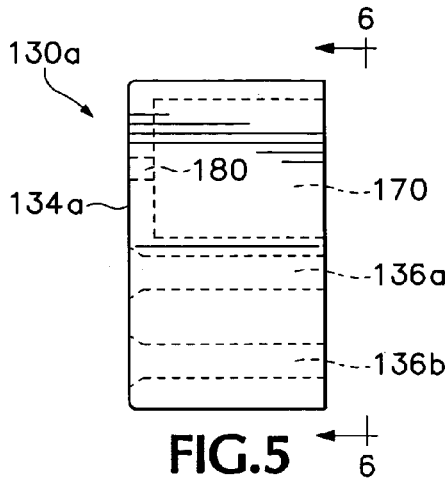
FIG. 5 is a side, sectional view of the sleeve assembly of FIG. 1 which has been modified to be adjustable to a plurality of dowel heights from the underlying subgrade surface and which further includes an air vent opening.
Figure 6:
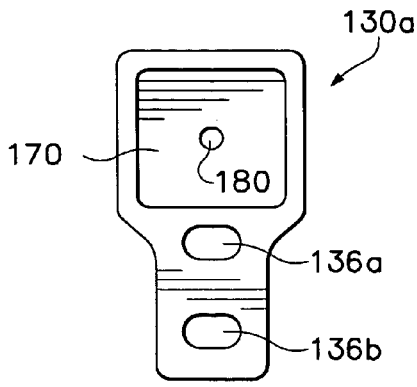
FIG. 6 is an end, sectional view taken along line 6-6 of the sleeve assembly of FIG. 5.
Figure 7:
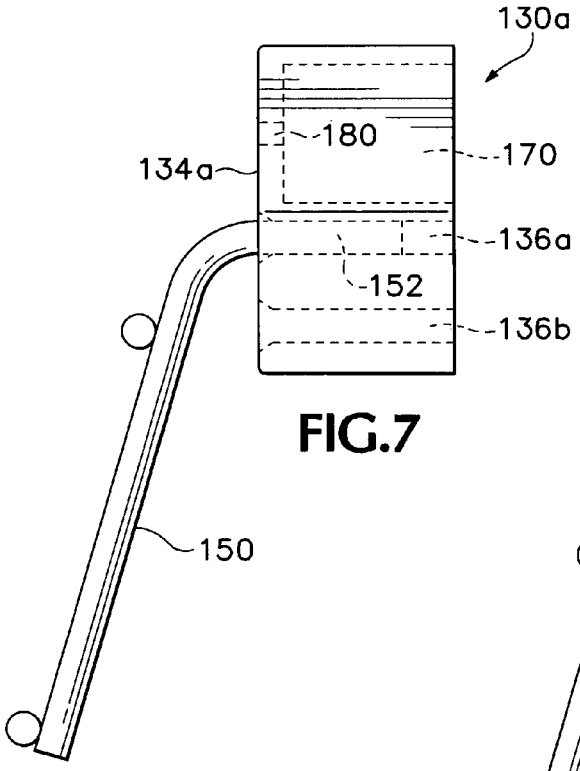
FIG. 7 is a side, sectional view of the sleeve assembly of FIG. 5 supported by a bracket member located in a first aperture at a first height above an underlying subgrade surface.
Figure 8:
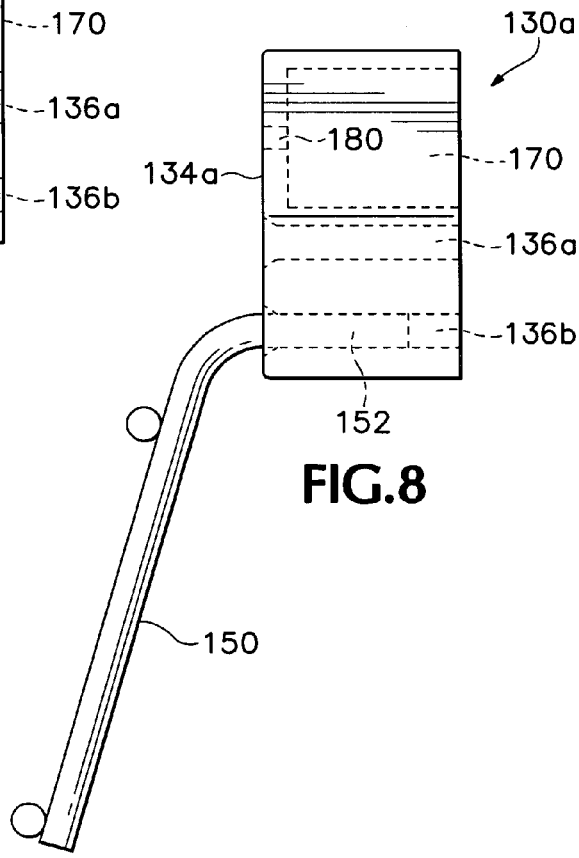
FIG. 8 is a side, sectional view of the sleeve assembly of FIG. 5 supported by a bracket member located in a second aperture at a second height above an underlying subgrade surface.

In FIG. 4 connection element 130 and the aperture 120 into which the connection element 130 is engagingly inserted, have a cross-sectional configuration which is elliptical in shape. Therefore, the connection element 130 will be substantially prevented from rotating within aperture 120.

In a preferred embodiment of FIGS. 5-8, end section 134*a* of the elongate sleeve body 130*a* defines a plurality of apertures 136*a*, 136*b* for use in providing adjustable positioning of the sleeve member 100*a* with respect to the bracket member 150. In this case, for example, the apertures 136*a*, 136*b* are located one above the other. The connection element 152 can be engagingly inserted and maintained within either of the aperture 136*a* or the aperture 136*b*, respectively. The remaining portion of the structure of the sleeve member 130*a* is the same as that of sleeve member 130. Generally, the plurality of apertures 136*a*, 136*b* are arranged in predetermined positions so that the height of the dowel bar 120 with respect to the underlying surface 200 can be adjusted as desired. End section 134*a* of elongate sleeve body 130*a* defines an opening 180, which is in communication with hollow interior compartment 170, for venting air into the atmosphere surrounding sleeve assembly 130*a* when the dowel bar 120 is introduced into the hollow interior compartment 170.

A method for maintaining adjacent sections of concrete in alignment during contraction and expansion of the concrete and for transferring shear stresses and bending moments across a joint 400 formed between adjacent concrete slabs 300 is also provided (see FIGS. 1 and 4). The method comprises providing sleeve assembly 130 for receiving and maintaining dowel bar 120 therewithin so that a dowel bar does not transmit substantial shear stresses to the concrete during the contraction and expansion of the concrete. Dowel bar 120 is provided. Dowel bar 120 is located within the confines of hollow interior compartment 170 for maintaining adjacent sections of concrete in alignment during contraction and expansion of the concrete, and for transferring shear stresses and bending moments across joint 400 formed between adjacent concrete slabs 300. Dowel bar 120 moves in a lateral and/or longitudinal path within the hollow interior compartment 170 and exerts interactive forces in response to the expansion and contraction of the concrete so as not to transmit substantial shear stresses to the concrete during the contraction and expansion of the concrete. Because of the structural design of sleeve assembly system 100, dowel bar 120 is typically capable of movement to a position which is substantially non-parallel with respect to an original position of the dowel bar when the system 100 was originally installed. Then, a pair of bracket members 150 is provided. These bracket members 150 are located on underlying surface 200. Connection elements 152 are then engagingly inserted into apertures 136 for supporting sleeve assembly 100 and dowel bar 120 above underlying surface 200.

Figure 9:
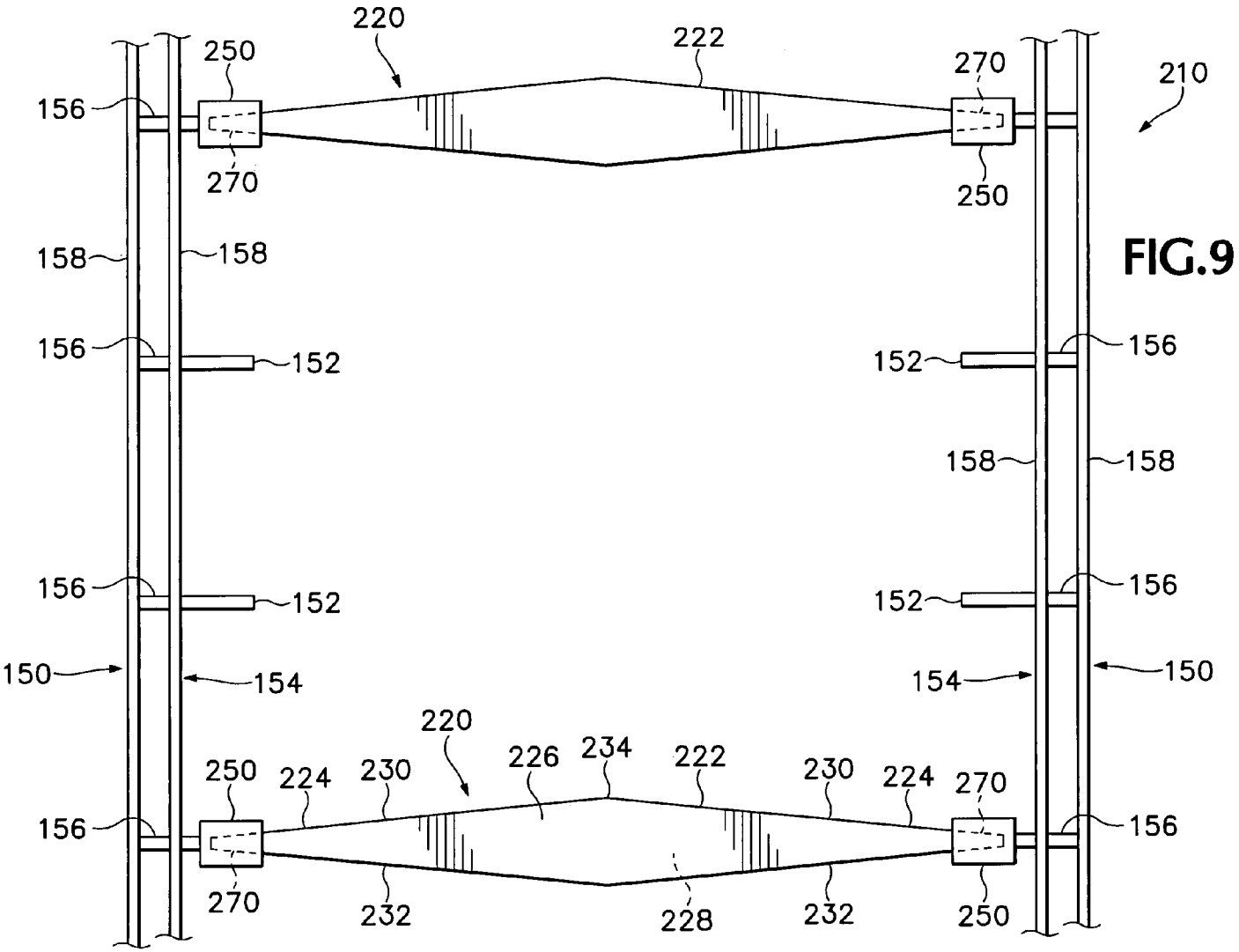
FIG. 9 is a plan, perspective view of a portion of a second concrete slab joint system of the present invention comprising a pair of sleeve members, a dowel bar having a tapered configuration, and a pair of bracket members supporting the sleeve members and dowel bar.
Figure 10:
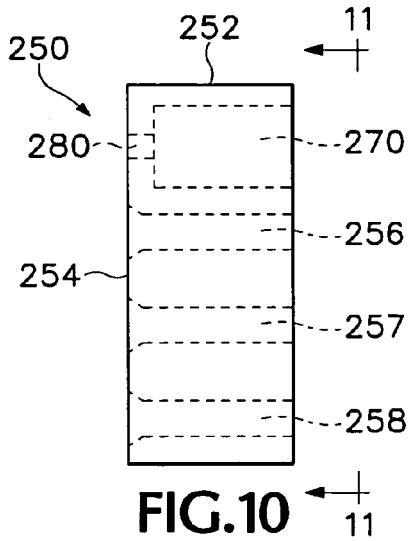
FIG. 10 is a side, sectional view of the sleeve assembly of FIG. 9 which has been modified to be adjustable to a plurality of dowel heights from the underlying subgrade surface and which further includes an air vent opening.
Figure 11:
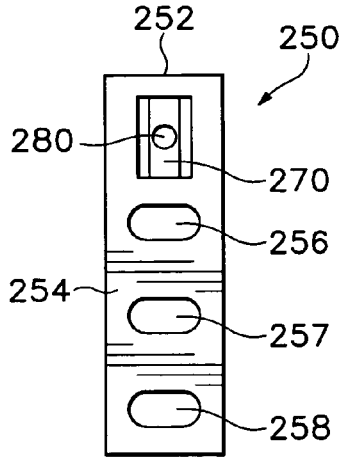
FIG. 11 is an end, sectional view taken along line 11-11 of the sleeve assembly of FIG. 9.
Figure 12:
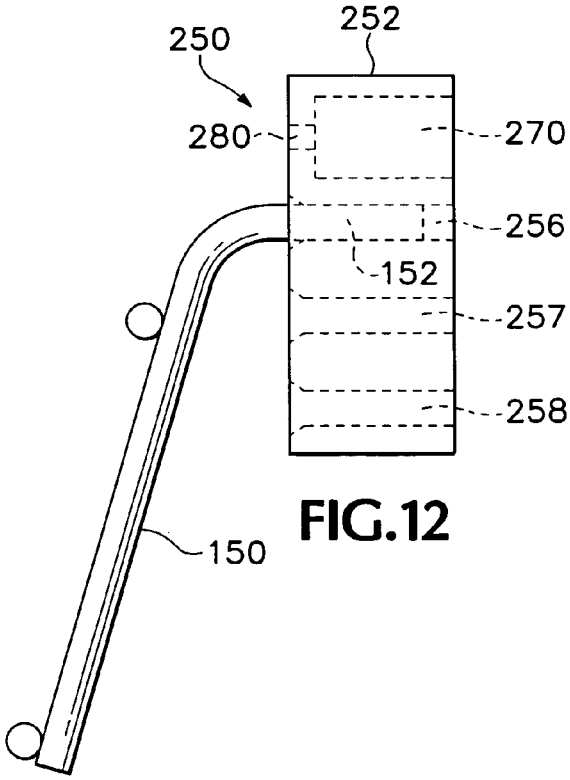
FIG. 12 is a side, sectional view of the sleeve assembly of FIG. 9 supported by a bracket member located in a first aperture at a first height above an underlying subgrade surface.
Figure 13:
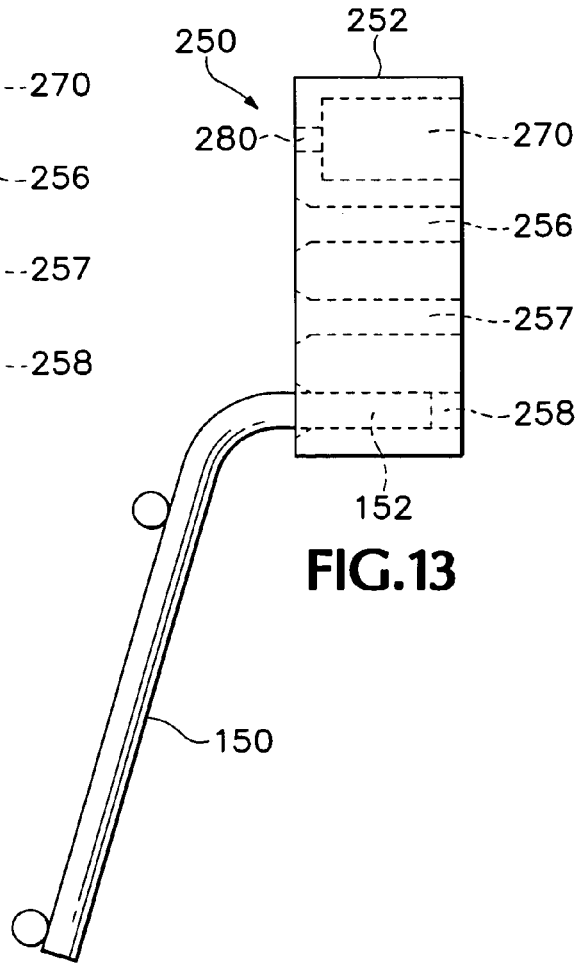
FIG. 13 is a side, sectional view of the sleeve assembly of FIG. 9 supported by a bracket member located in a second aperture at a second height above an underlying subgrade surface.

Referring now to FIG. 9, concrete dowel slab joint system 210 is depicted. More specifically, the system 210 receives dowel bar 220, which is typically fabricated of a metallic or polymeric material, preferably steel dowel bar. Dowel bar 220 an elongate dowel body 222. Dowel body 222 includes a pair of end sections 224. The elongate sleeve body includes an upper outer surface 226, a lower outer surface 228 and a pair of side outer surfaces 230, 232. Side outer surfaces 230, 232 comprise a tapered configuration the slope of which extends from substantially the middle portion 234 of the elongate dowel body and gradually narrows toward each of the end sections 222. The tapered configuration of the elongate dowel body 222 is sufficient to overcome the effect caused if concrete joint separation skews the original position of the dowel bar 220. The angle of the slope of the side outer surfaces 230, 232 from the end sections 224 to the middle portion 234 preferably comprises up to about 15 degrees, more preferably up to about 12 degrees, and most preferably up to about 10 degrees.

Sleeve members 250 receives and maintains dowel bar 220 within its confines without transmitting substantial shear stresses to the concrete slab 300 during the contraction and expansion of the slab 300. Dowel bar 220 moves in a lateral and/or longitudinal path within the hollow interior compartment and exerts interactive forces in response to the expansion and contraction of the concrete. Dowel bar 220 is also preferably capable of movement to a position which is substantially non-parallel with respect to its original position when the concrete dowel slab joint system 200 was originally installed in the concrete slab 300.

In further preferred embodiments shown in FIGS. 9-13, end section 254 of the sleeve body 252 of sleeve member 250 defines a plurality of apertures 256, 258 for use in providing adjustable positioning of the sleeve member 250 with respect to the bracket member 150. In this case, for example, the apertures 256, 258 are located one above the other. The connection element 152 can be engagingly inserted and maintained within either of the aperture 256 or the aperture 258, respectively. The remaining portion of the structure of the sleeve member 250 is substantially the same as that of sleeve member 130. Generally, the plurality of apertures 256, 258 are arranged in predetermined positions so that the height of the dowel bar 220 with respect to the underlying surface 200 can be adjusted as desired. End section 254 of sleeve body 252 defines an opening 280, which is in communication with hollow interior compartment 270, for venting air into the atmosphere surrounding sleeve member 250 when the dowel bar 220 is introduced into the hollow interior compartment 270.

In FIG. 9 (as in FIG. 4), connection element 130 and the apertures 256, 258 into which the connection element 130 is engagingly inserted, have a cross-sectional configuration which is elliptical in shape. Therefore, the connection element 130 will be substantially prevented from rotating within apertures 256, 258.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

The invention claimed is:

1. A concrete dowel slab joint system, comprising:

a plurality of sleeve members for receiving and maintaining a dowel bar therewithin so that the dowel bar does not transmit substantial shear stresses to the concrete during the contraction and expansion of the concrete, the sleeve members comprising (a) at least one hollow interior compartment for receiving and supporting said dowel bar, and (b) at least one aperture for receiving a bracket member;

said dowel bar having a tapered configuration and a pair of end sections, said dowel bar being located within said hollow interior compartment for maintaining adjacent sections of concrete in alignment during contraction and expansion of the concrete, and for transferring shear stresses and bending moments across a joint formed between adjacent concrete slabs, the dowel bar moving in a lateral and/or longitudinal path within the hollow interior compartment and exerting interactive forces in response to the expansion and contraction of the concrete, the tapered configuration of said dowel bar providing supplemental structural support for the dowel bar which is sufficient to overcome the effect caused if concrete joint separation skews the original position of the dowel bar; and a plurality of bracket members located on an underlying surface for supporting said sleeve members and said dowel bar above said underlying surface, each said bracket member comprising at least one connection element which is engagingly insertable into each said aperture, each said bracket member and sleeve member being movable with respect to each other when shrinkage of the concrete occurs.

2. The concrete dowel slab joint system of claim 1, wherein the dowel bar comprises an upper outer surface, a lower outer surface and a pair of side outer surfaces, and at least one of said pair of side outer surfaces comprises a tapered configuration which gradually narrows toward each said end section of the dowel bar.

3. The concrete dowel slab joint system of claim 2, wherein said pair of side outer surfaces comprise a tapered configuration which gradually narrow toward each said end section of the dowel bar.

4. The concrete dowel slab joint system of claim 1, wherein each said bracket member includes a stanchion joined to said connection element and located on said underlying surface for supporting each said sleeve member and said dowel bar, respectively.

5. The concrete dowel slab joint system of claim 1, wherein the bracket member comprises a support framework.

6. The concrete dowel slab joint system of claim 2, wherein the slope of the tapered configuration extends from substantially the middle portion of the dowel bar and gradually narrows toward each of the end sections.

7. The concrete dowel slab joint system of claim 1, wherein said sleeve member is fabricated of a polymeric material and/or said bracket member is fabricated of a polymeric material or a metal material and/or said dowel bar is fabricated of a metal material or a polymeric material.

8. The concrete dowel slab joint system of claim 1, wherein each said bracket member supports a sleeve a dowel bar at a plurality of locations with respect to said underlying surface.

9. The concrete dowel slab joint system of claim 1, wherein each bracket member comprises a plurality of connection elements.

10. The concrete dowel slab joint system of claim 1, wherein said support member defines a plurality of apertures for receiving a bracket member at a plurality of locations for adjusting the height of the dowel bar to a plurality of locations with respect to the underlying surface.

11. A concrete dowel slab joint system, which comprises a plurality of sleeve members for receiving and maintaining the dowel bar therewithin so that a dowel bar does not transmit substantial shear stresses to the concrete during the contraction and expansion of the concrete, the sleeve members defining (a) at least one hollow interior compartment for receiving and supporting a dowel bar, and (b) at least one aperture for receiving a bracket member, each said bracket member and each sleeve member being movable with respect to each other when shrinkage of the concrete occurs, said bracket member being located on an underlying surface for supporting said sleeve assembly system above said underlying surface; and said dowel bar being located within said hollow interior compartment for maintaining adjacent sections of concrete in alignment during contraction and expansion of the concrete, and for transferring shear stresses and bending moments across a joint formed between adjacent concrete slabs, the dowel bar moving in a lateral and/or longitudinal path within the hollow interior compartment and exerting interactive forces in response to the expansion and contraction of the concrete, said dowel bar being capable of movement to a position which is substantially non-parallel with respect to an original position of the dowel bar when the concrete dowel slab joint system was originally installed.

12. A method for maintaining adjacent sections of concrete in alignment during contraction and expansion of the concrete and for transferring shear stresses and bending moments across a joint formed between adjacent concrete slabs, which comprises:

providing sleeve members for receiving and maintaining the dowel bar therewithin so that a dowel bar does not transmit substantial shear stresses to the concrete during the contraction and expansion of the concrete, the sleeve members comprising (a) at least one hollow interior compartment, and (b) at least one aperture for receiving a bracket member;

providing a dowel bar;

locating the dowel bar within said hollow interior compartment for maintaining adjacent sections of concrete in alignment during contraction and expansion of the concrete, and for transferring shear stresses and bending moments across a joint formed between adjacent concrete slabs, the dowel bar moving in a lateral and/or longitudinal path within the hollow interior compartment and exerting interactive forces in response to the expansion and contraction of the concrete so as not to transmit substantial shear stresses to the concrete during the contraction and expansion of the concrete, said dowel bar being capable of movement to a position which is substantially non-parallel with respect to an original position of the dowel bar when the concrete dowel slab joint system was originally installed;

providing a plurality of bracket members;

locating each said bracket member on an underlying surface, each bracket member comprising at least one connection element; and engagingly inserting each said connection element into each said aperture for supporting said sleeve assembly and dowel bar above said underlying surface, each said bracket member and sleeve assembly being movable with respect to each other when shrinkage of the concrete occurs.

13. The method of claim 12, wherein the dowel bar comprises an upper outer surface, a lower outer surface and a pair of side outer surfaces, and at least one of said pair of side outer surfaces comprise a tapered configuration which gradually narrows toward each end section of the elongate sleeve body.

14. The method of claim 12, wherein said pair of side outer surfaces comprises a tapered configuration which gradually narrows toward each end section of the elongate sleeve body.

15. The method of claim 12, wherein said bracket member includes a stanchion joined to said connection element and located on said underlying surface for supporting each said sleeve member and said dowel bar.

16. The method of claim 12, wherein the bracket member comprises a support framework.

17. The method of claim 12, wherein the sleeve member and/or bracket member and/or dowel bar are fabricated from a metal material or a polymeric material.

18. The method of claim 12, wherein each bracket member supports a dowel bar at a plurality of locations with respect to the underlying surface.

19. The method of claim 12, wherein each bracket member comprises a plurality of connection elements.

20. The method of claim 12, wherein said support member defines a plurality of apertures for receiving a bracket member at a plurality of locations for adjusting the height of the dowel bar to a plurality of locations with respect to the underlying surface.

21. A concrete slab including a plurality of concrete dowel slab joint systems, each concrete dowel slab joint system comprising a plurality of sleeve members for receiving and maintaining a dowel bar therewithin so that the dowel bar does not transmit substantial shear stresses to the concrete during the contraction and expansion of the concrete, the sleeve members comprising (a) at least one hollow interior compartment for receiving and supporting said dowel bar, and (b) at least one aperture for receiving a bracket member;

said dowel bar having a tapered configuration and a pair of end sections, said dowel bar being located within said hollow interior compartment for maintaining adjacent sections of concrete in alignment during contraction and expansion of the concrete, and for transferring shear stresses and bending moments across a joint formed between adjacent concrete slabs, the dowel bar moving in a lateral and/or longitudinal path within the hollow interior compartment and exerting interactive forces in response to the expansion and contraction of the concrete, the tapered configuration of said dowel bar providing supplemental structural support for the dowel bar which is sufficient to overcome the effect caused if concrete joint separation skews the original position of the dowel bar; and a plurality of bracket member located on an underlying surface for supporting said sleeve members and said dowel bar above said underlying surface, each said bracket member comprising at least one connection element which is engagingly insertable into each said aperture, each said bracket member and sleeve member being movable with respect to each other when shrinkage of the concrete occurs.

22. The concrete dowel slab joint system of claim 1, wherein at least one connection element, and the aperture into which the connection element is engagingly inserted, have a cross-sectional configuration which is not circular in shape so that the connection element will substantially prevented from rotating within said aperture.

23. The concrete dowel slab joint system of claim 11, wherein at least one connection element, and the aperture into which the connection element is engagingly inserted, have a cross-sectional configuration which is not circular in shape so that the connection element will substantially prevented from rotating within said aperture.

24. The method of claim 12, wherein at least one connection element, and the aperture into which the connection element is engagingly inserted, have a cross-sectional configuration which is not circular in shape so that the connection element will substantially prevented from rotating within said aperture.

25. The concrete dowel slab joint system of claim 1, wherein each said sleeve member defines an opening in communication with said hollow interior compartment for venting air into the atmosphere surrounding said sleeve assembly when the dowel bar is introduced into said hollow interior compartment.

26. The concrete dowel slab joint system of claim 11, wherein each said sleeve member defines an opening in communication with said hollow interior compartment for venting air into the atmosphere surrounding said sleeve assembly when the dowel bar is introduced into said hollow interior compartment.

27. The method of claim 12, wherein each said sleeve member defines an opening in communication with said hollow interior compartment for venting air into the atmosphere surrounding said sleeve assembly when the dowel bar is introduced into said hollow interior compartment.

* * * * *